US011229562B2

(12) United States Patent
Maiolo et al.

(10) Patent No.: US 11,229,562 B2
(45) Date of Patent: Jan. 25, 2022

(54) TILT LOCK MECHANISM FOR A TILTING WHEELCHAIR SEAT

(71) Applicant: RAZ DESIGN INC., Toronto (CA)

(72) Inventors: Ethan Maiolo, Niagara Falls (CA); Nelson Pang, Toronto (CA); David Harding, Toronto (CA)

(73) Assignee: RAZ DESIGN INC., Ontario (CA)

( * ) Notice: Subject to any disclaimer, the term of this patent is extended or adjusted under 35 U.S.C. 154(b) by 0 days.

(21) Appl. No.: 17/273,106

(22) PCT Filed: Jan. 30, 2019

(86) PCT No.: PCT/CA2019/000012

§ 371 (c)(1),
(2) Date: Mar. 3, 2021

(87) PCT Pub. No.: WO2020/047646

PCT Pub. Date: Mar. 12, 2020

(65) Prior Publication Data

US 2021/0220198 A1 Jul. 22, 2021

(30) Foreign Application Priority Data

Sep. 5, 2018 (CA) ..... 3016506

(51) Int. Cl.
*A61G 5/10* (2006.01)

(52) U.S. Cl.
CPC ..... *A61G 5/1075* (2013.01)

(58) Field of Classification Search
CPC ..... A61G 5/1075; B62B 3/08; B62B 7/006; B62B 7/145; B62B 9/102; B62B 9/12
See application file for complete search history.

(56) References Cited

U.S. PATENT DOCUMENTS 2,308,965 A * 1/1943 Riesing ..... F16F 1/3732 384/220
4,759,561 A 7/1988 Janssen
(Continued)

FOREIGN PATENT DOCUMENTS

| | | | |
|---|---|---|---|
| CA | 2546741 | A1 | 5/2000 |
| DE | 29719462 | U1 | 1/1998 |
| WO | 2009/019026 | A1 | 2/2009 |

OTHER PUBLICATIONS

International Search Report and Written Opinion from PCT International Application No. PCT/CA2019/000012, dated May 21, 2019.

*Primary Examiner* — Steve Clemmons
(74) *Attorney, Agent, or Firm* — Budzyn IP Law, LLC

(57) ABSTRACT

A tilt lock mechanism for a wheelchair having a tilting seat frame pivotally mounted to a non-tiling base frame. The tilt lock mechanism including a catch release member mounted to the tiling seat frame, the catch release member having a guide surface; and the catch release member having a tilt lock position and a tilt lock release position. A locking tab is mounted to the non-tilting base frame, which is sized and shaped to engage the guide surface when said catch release member is in the tilt lock release position. A plurality of locking slots are formed in the tilting seat frame and the locking tab engages one of the locking slots when the catch release member is in the tilt lock position. As well an actuator is provided for moving the catch release member between the tilt lock position and the tilt lock release position.

10 Claims, 12 Drawing Sheets

(56) References Cited

U.S. PATENT DOCUMENTS

| | | | | |
|---|---|---|---|---|
| 5,044,647 | A | 9/1991 | Patterson | |
| 6,003,891 | A | 12/1999 | Broadhead | |
| 6,086,086 | A * | 7/2000 | Hanson | A61G 5/0891 280/650 |
| 6,126,186 | A * | 10/2000 | Mascari | A61G 5/1075 280/220 |
| 6,203,106 | B1 * | 3/2001 | Nearing | A61G 5/107 297/284.9 |
| 6,206,393 | B1 | 3/2001 | Mascari et al. | |
| 6,257,609 | B1 * | 7/2001 | O'Neill, Sr. | A61G 5/107 280/250.1 |
| 7,007,965 | B2 | 3/2006 | Bernatsky et al. | |
| 8,235,407 | B2 | 8/2012 | Cerreto et al. | |
| 8,322,741 | B2 | 12/2012 | Laslo et al. | |
| 8,359,946 | B2 * | 1/2013 | Kainzner | F16C 1/14 74/502.6 |
| 8,419,130 | B2 | 4/2013 | Bergman | |
| 8,579,315 | B2 | 11/2013 | Balcom et al. | |
| 8,944,454 | B2 | 2/2015 | Blauch et al. | |
| 9,033,360 | B2 | 5/2015 | Davis et al. | |
| 9,408,763 | B2 | 8/2016 | Purdue et al. | |
| 9,452,096 | B2 | 9/2016 | Jahkel et al. | |
| 9,554,955 | B2 | 1/2017 | Blauch et al. | |
| 9,938,754 | B2 * | 4/2018 | Rosales | E05B 53/005 |
| 2007/0085301 | A1 | 4/2007 | Watkins | |
| 2009/0085324 | A1 | 4/2009 | Blauch et al. | |
| 2010/0156065 | A1 * | 6/2010 | Cerreto | A61G 5/1075 280/281.1 |
| 2014/0070590 | A1 * | 3/2014 | Zhong | A47D 13/02 297/423.19 |
| 2014/0246841 | A1 | 9/2014 | Slagerman et al. | |
| 2017/0273840 | A1 * | 9/2017 | Melgarejo | A61G 5/1075 |

* cited by examiner

TILT LOCK MECHANISM FOR A TILTING WHEELCHAIR SEAT

FIELD OF THE INVENTION

This invention relates generally to the field of tilting seats and more particularly to the field of tilting seats for wheelchairs. Most particularly this invention relates to tilt lock mechanisms of the sort that may be unlocked to permit an adjustment to the degree of tilt of a wheelchair seat to suit a patient's needs and which then may be locked to keep the patient and the wheelchair seat at a desired degree of tilt.

BACKGROUND OF THE INVENTION

Various tilt lock systems are known in the prior art, including cable activated systems which have a manual actuator located on the handle of the wheelchair and the other end of the cable connected to the locking mechanism. In this way, the tilt function can be easily controlled by a caregiver who may be pushing the wheelchair by means of the handles. However, many of these known tilt lock systems have a problem in that one end of the cable is attached to the tilting portion of the wheelchair and the other end is attached to the non-tilting base. As a result, the distance between the ends of the cable changes significantly as the seat portion tilts. If for example, the top of the chair tilts down, the distance between the ends of the cable can shorten, which causes the cable to bow significantly. In addition to looking unkempt, the bow in the cable can prevent proper operation of the tilt lock system or present a safety hazard by catching on things that the wheelchair is passing by. What is desired is a tilt lock system that can be integrated into the wheelchair and for which the cables are neatly and closely contained through all angles of tilt.

U.S. Pat. No. 8,235,407 discloses a tilting wheelchair which includes a tilt lock system. The patent teaches using curved rails to guide the tilting motion of a tiltable frame which sits on a base. An arcuate track adjustment portion permits pivotal adjustment of the focus about which the seat frame rotates. In FIGS. 9A-B the tilt release mechanism is shown. There is provided a curved rail on the base frame which has many indents on an upper inner face. A cable runs from the handle to a locking element, where the locking element is also attached to the tilting frame portion. The cable operated locking element engages the indents of the stationary frame of base portion. By pulling on the cable the locking element can be pulled directly out of the indent and then the seat frame is unlocked and can be tilted. As shown the distance between the ends of the cable will be constant through all angles of tilt, since both the handle end and the locking element end are mounted to the tilting frame. However, the locking indents are formed on the upper part stationary frame and thus are exposed. The exposed indents can then become soiled and may be difficult to clean. Further, placing the locking indents on the stationary base requires that indents must be provided for the full range of tilt, meaning that the base size is dictated in part by the range of travel rather than what might be otherwise required for strength requirements for example. A different system is desired. Examples of various prior mechanisms are found in the following references:

U.S. Pat. No. 9,554,955
U.S. Pat. No. 9,452,096
U.S. Pat. No. 9,408,763
U.S. Pat. No. 9,033,360
U.S. Pat. No. 8,944,454

U.S. Pat. No. 8,579,315
U.S. Pat. No. 8,419,130
U.S. Pat. No. 8,322,741
U.S. Pat. No. 8,235,407
U.S. Pat. No. 7,007,965
U.S. Pat. No. 6,206,393
U.S. Pat. No. 6,126,186
U.S. Pat. No. 6,003,891
U.S. Pat. No. 5,044,647
U.S. Pat. No. 4,759,561
United States Publication No. 2014/0246841
United States Publication No. 2009/0085324
United States Publication No. 2007/0085301
Canadian Patent No. 2,546,741
International Application No. WO2009/019026

SUMMARY OF THE INVENTION

The present invention is directed to a tilt lock mechanism for a wheelchair having a tilting seat in a base frame and in a preferred embodiment a cable activated locking element, in which the distance between the ends of the cable is the same through all tilt angles. The present invention may further provide for the locking element to interface with locking indents in a manner such that the angle of tilt for the seat can be adjusted. In one embodiment, the activation by a manual actuator on the handle of the seat portion allows the locking element to be released from the locking indents. The locking element can be re-engaged with a locking indent by means of releasing the actuator. A return spring may be provided to ensure the locking element is securely seated in a locked position. An ejector band, or catch release member connected to the cable, may be used to lift the locking element out of the locked position and to provide a glide or guide surface to allow the locking indents of the tilting seat frame to be translated past the locking element to a new locking position. The ejector band may be sized, shaped and positioned to be supported along its length in the raised or lifted position to permit the locking element to ride along the guide surface on the ejector band to a new locking slot position there to be selectively engaged in a locking position at new seat tilt angle. The tilting frame of the wheelchair may be provided with a series of locking slots along an underside of the frame and the tilting portion and the ejector band may be sized to be complementary in length to the length of the series of locking slots. The locking element may be mounted to the base frame of the wheelchair and the ejector band and locking slots may be incorporated into the tilting seat frame part of the wheelchair. Thus, the locking element may be stationary through the tilting action, while the locking slots or indents are translated past the fixed locking element. In the preferred embodiment both ends of the cable may be secured to the tilting portion of the wheelchair, so the distance between the ends of the cable remains the same through all angles of tilt.

Therefore, in one embodiment the present invention provides a tilt lock mechanism for a wheelchair, the wheelchair having a tilting seat frame pivotally mounted to a non-tilting base frame, the tilt lock mechanism comprising: a catch release member mounted to said tilting seat frame, the catch release member having a guide surface; said catch release member having a tilt lock position and a tilt lock release position, a locking tab mounted to said non-tilting base frame, said locking tab being sized and shaped to engage said guide surface when said catch release member is in the tilt lock release position; a plurality of locking slots formed in said tilting seat frame, wherein at least one of said locking slots engages said locking tab when said catch release member is in the tilt lock position; and an actuator operatively connected to said catch release member for moving said catch release member between said tilt lock position and said tilt lock release position.

The present invention further provides in a further embodiment a tilt lock mechanism for a tilting wheelchair, the tilting wheelchair having a tilting seat frame mounted to a base frame, said tilt lock mechanism comprising: a cable to communicate manual displacement from one end of said cable to the other wherein both ends of said cable are mounted to said tilting seat frame; a manual actuator operatively connected at one end of said cable and a catch release member operatively connected to the other end of said cable, said catch release element including a guide surface for guiding a locking tab; a series of locking indents formed into said tilting seat frame; and a locking tab sized, shaped and positioned to engage one or more of said series of locking indents, said locking tab being mounted to said base frame in a position where the locking tab is engageable with said catch release member and said indents; wherein movement of said manual actuator moves said cable to cause said catch release member to engage or disengage said locking tab from one or more of said locking indents to permit said tilting seat frame to be tilted to a preferred degree of tilt and then locked into said tilted position.

BRIEF DESCRIPTION OF THE DRAWINGS

Reference will now be made by way of example only to preferred embodiments of the invention by reference to the following drawings in which.

DETAILED DESCRIPTION OF THE PREFERRED EMBODIMENTS

Figure 1:
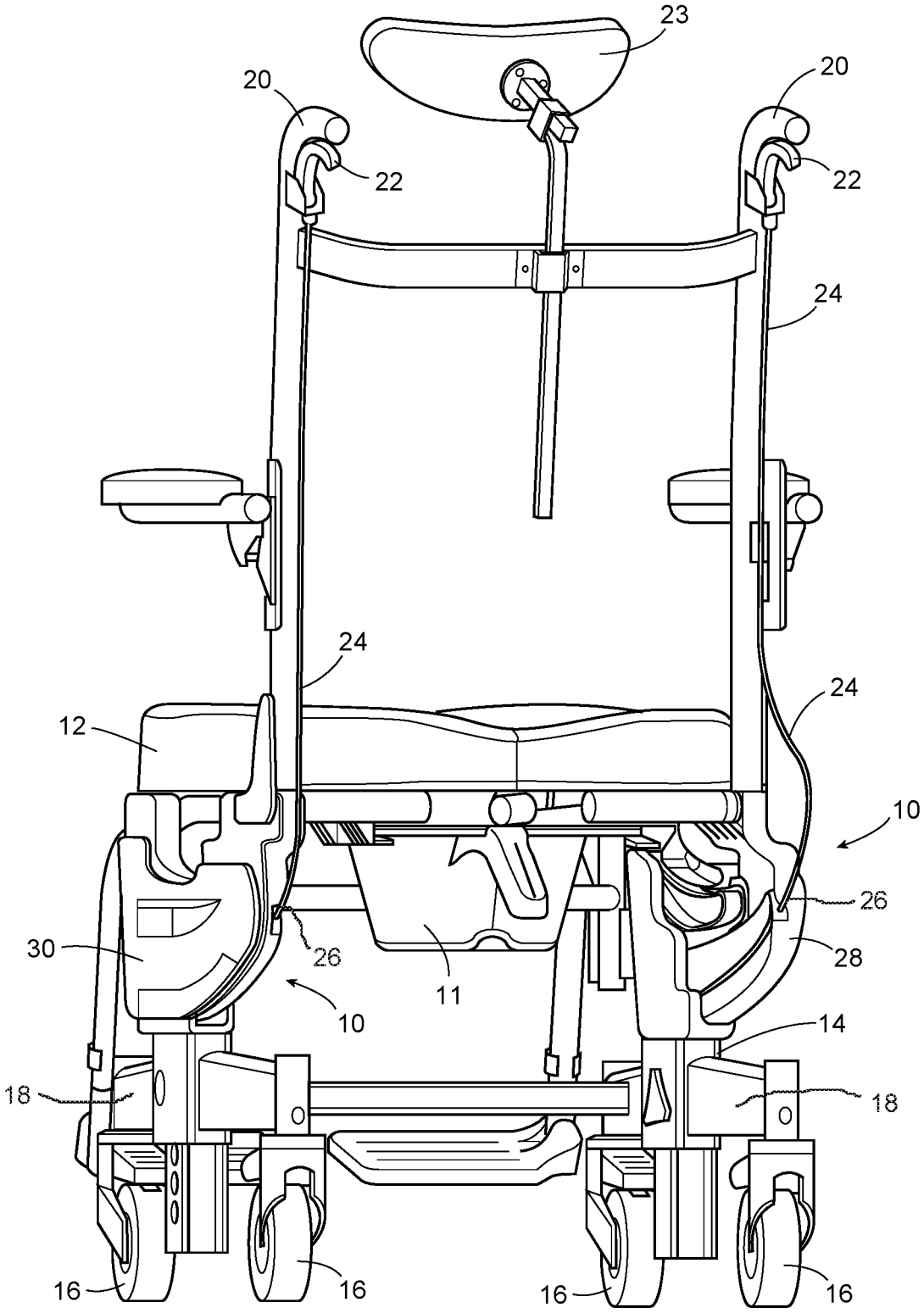
FIG. 1 is a rear view of a tilting wheelchair according to a preferred embodiment of the present invention.

FIG. 1 shows a tilting wheelchair from behind having a tilt lock mechanism according to the present invention generally at 10. This wheelchair includes a commode type of seat (with a removeable bedpan 11) but the tilt lock mechanism of the present invention may apply to other forms of wheelchairs as well. As shown in a preferred embodiment the tilt lock mechanism may be mounted to both sides of the wheelchair for strength and safety reasons. The wheelchair has a tilting seat portion 12, which is mounted to a non-tilting base 14. The non-tilting base 14 includes four wheels 16 and opposed frame elements 18. The tilting seat portion 12 may include handles 20, and may have one or more manual actuators or levers 22 mounted to the handle 20 wherein the levers 22 are operatively connected to the tilt lock mechanism. An adjustable height headrest is shown at 23. A cable or wire 24 may extend from the manual actuator 22 on the handle 20 to a lower part of the tilting frame at the fixed connection 26.

Figure 2:
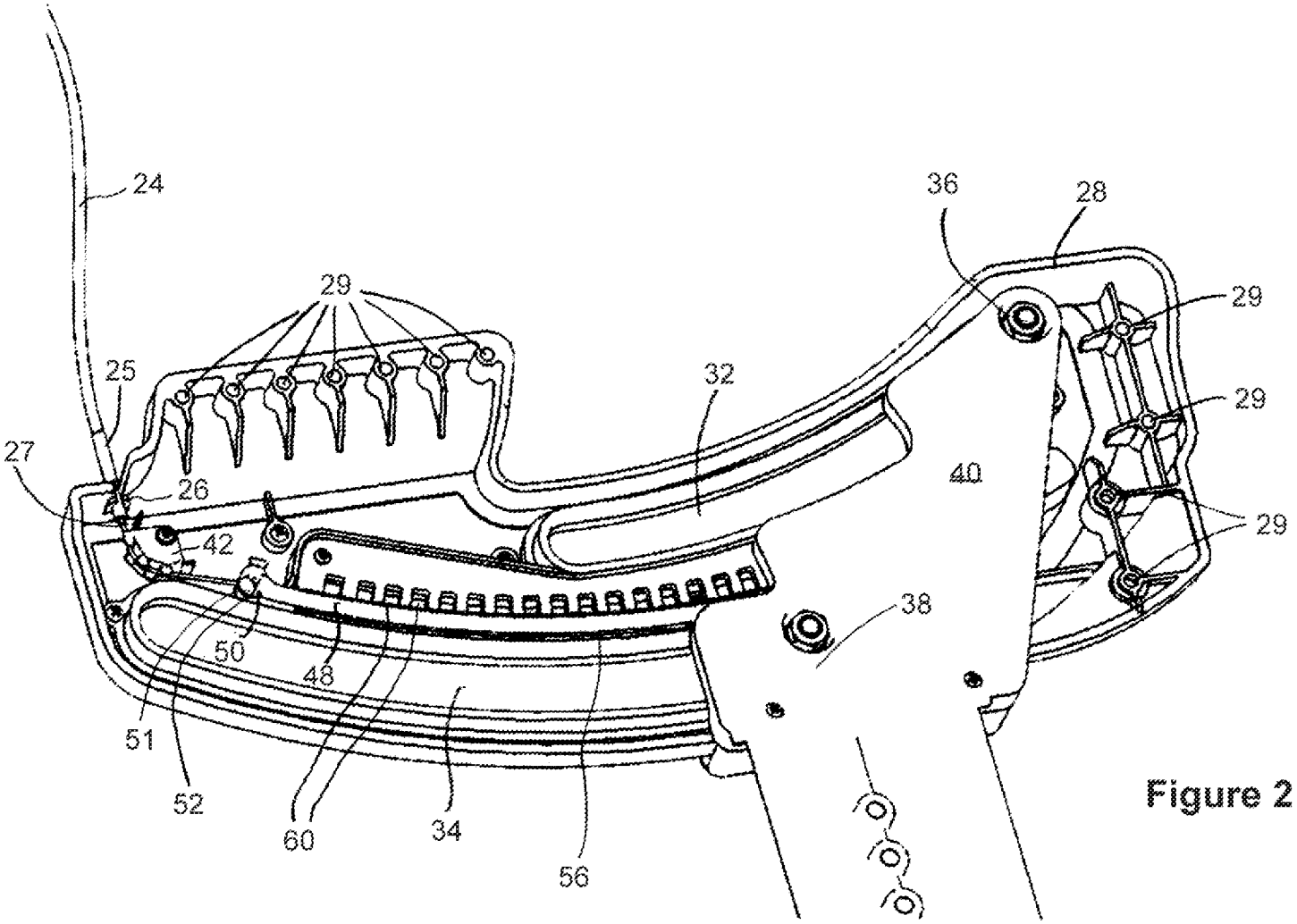
FIG. 2 is a close-up view of the tilt locking mechanism according to a preferred embodiment of the present invention.

As shown in FIG. 2, in one embodiment the form of operative connection may be the cable 24 which may consist of an outer sheath 25 and a central wire 27 as is known in the art. In this way moving one end of the wire 27 by the lever or actuator 22 allows the other end of the wire 27 to move the same amount. The outer sheath 25 remains stationary but permits the wire 27 to slide within it past the fixed connection 26. Also shown in FIG. 1 are side plates 28 and 30 which contain some of the elements of the tilt lock mechanism 10 of the present invention, as described in more detail below.

Also shown in FIG. 2 is an enlarged view of one of the side plates, namely, side plate 28, with various components removed for ease of illustration and understanding. The tilting side plate 28 may be formed from metal for strength reasons and may include two slots, 32 and 34, which in this embodiment are arcuate. Rollers 36 and 38 may be located within the slots 32, 34 as shown. The rollers are rotatably mounted to base frame plate 40, which forms part of the non-tilting base of the wheelchair. Movement of the rollers in the arcuate slots permits the tilt angle of the wheelchair seat 12 to be adjusted. The side plate 28 includes a plurality of fastener openings 29, which can be used to attach the side plate 28 to the wheelchair seat frame which is not shown in this view. In this way, the side plate 28 and attached seat can be pivoted relative to the frame plate 40, allowing the angle of a user to be easily adjusted.

FIG. 2 also shows some of the components of the tilt lock mechanism 10 of the present invention according to a preferred embodiment. The outer sheath 25 of the cable 24 attaches at 26. A slotted fitting 42 on the end of the sheath 25 is captured in a slot (not shown) formed in the side plate 28. It will be understood by those skilled in the art that the term slot as used in this description comprehends various forms of openings including holes, indents and the like. The wire 27 extends past the slotted fitting 42 and attaches to an ejector band 48 at 50. In this specification, the term ejector band is used, but it will be understood that the term ejector band is a preferred embodiment of a locking tab release mechanism or catch release member, of a locking tab release mechanism, as described in more detail below. The ejector band may be considered broadly as any element that can disengage the locking tab from a locking slot (as explained in detail below), to permit the locking tab to remain disengaged through the range of tilting motion of the seat frame relative to the base frame and then allow the locking tab to re-engage a locking slot to assume a locked position at the desired angle of tilt.

In this preferred embodiment, the attachment of the wire 27 to the ejector band 48 takes the form of a small head 51 on the end of the wire 27 which fits into a transverse slot 52 formed in the end 50 of the ejector band 48. As can now be understood, movement at the handle end of the manual actuator of a lever connected to the wire 27 moves the wire 27 relative to the sheath 25 which in turn moves the ejector band 48 either towards or away from the end of the sheath 25. In one embodiment, the wire is made stiff so that the ejector band may be moved in either direction, namely it can be both pulled and pushed. In another embodiment, the wire can be made flexible, so that a spring is used to return the ejector band to a starting position as described in more detail below. While this is one form of attachment of the end of the wire to the ejector band, which is convenient as it can be easily inserted or removed without needing the use of tools or the like, it will be appreciated by those skilled in the art that other forms of attachment are also comprehended by the present invention including both releasably and permanent attachment mechanisms.

FIG. 2 also shows the arcuate groove 56 in which the ejector band 48 is housed. The groove 56 includes ramp slots 58 on one side of the groove 56 (see FIG. 4) and locking slots 60 on the other side of the groove 56, which can now be understood. Also shown in FIGS. 5, 11 and 12 is a locking tab 62 which is pivotally attached to the stationary frame plate 40, by means of pivot mount 64. A pair of tip reinforcing plates 66, may be provided which reinforce the end of the tip. In general terms, pulling on the wire 27, pulls the ejector band 48 towards the cable attachment point 26, which causes the ejector band to slide up the ramps 58 as described below in FIGS. 3 and 4, which in turn raises the locking tab 62 out of a given locking slot 60, thereby allowing the side plate 28 to pivot on rollers 36 and 38 relative to the stationary frame plate 40. This is also described in more detail below.

Figure 3:
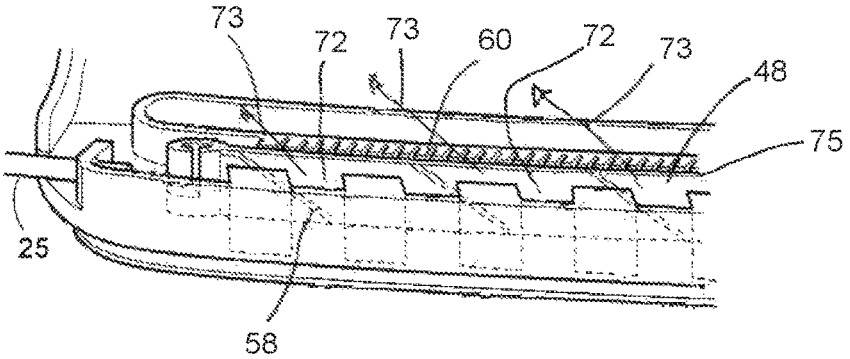
FIG. 3 is a bottom view of a portion of the tilt locking mechanism of FIG. 2.

FIG. 3 shows the ejector band 48 from below in part ghost section. The ejector band 48 may be formed with angled tabs 72 which engage the ramp slots 58 as can now be understood. As the end of the ejector band 48 is drawn towards the end of the arcuate groove 56, the angled tabs 72 engage with the ramp slots 58 to move the ejector band 48 in an upwardly direction 73 in FIG. 3 or an outwardly direction in FIG. 2. In other words, the ejector band 48 is moved laterally in the slot away from the side plate 28 by means of the pulling movement of the wire 27. As shown, the ejector band 48 is provided with angled tabs 72 along its length, which means that as the ejector band is pulled by the wire towards the wire connection end it rises up the ramp slots and away from the side plate 28 in the direction of arrows 73. The tabs could be replaced with slots instead, which would be mechanically equivalent as will be understood by those skilled in the art. Because the angled tabs slots and mating angled tabs are provided along the length of the ejector band 48, the ejector band will be raised out of the arcuate groove 56 and supported generally evenly along its whole length. This means that a guide surface 75 is also supported generally along its length. This facilitates the operation of the invention as described in more detail below. Although angled tabs are shown in this embodiment the present invention comprehends using angled slots in the ejector band as an alternative.

Figure 4:
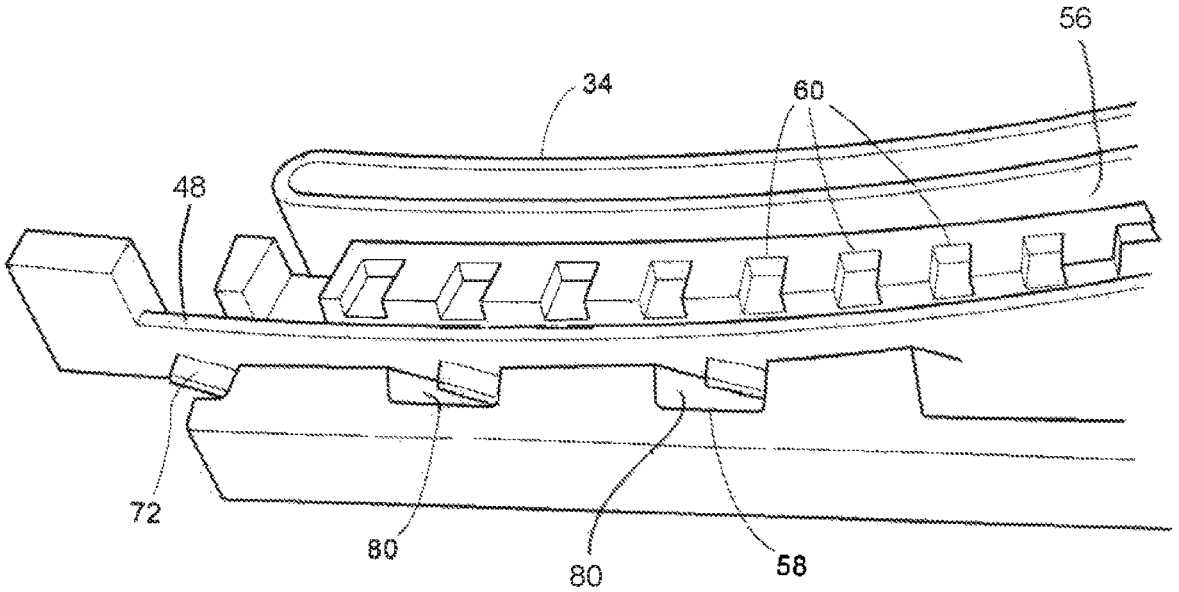
FIG. 4 is a close-up view of a portion of the locking system according to a preferred aspect of the present invention.
Figure 5:
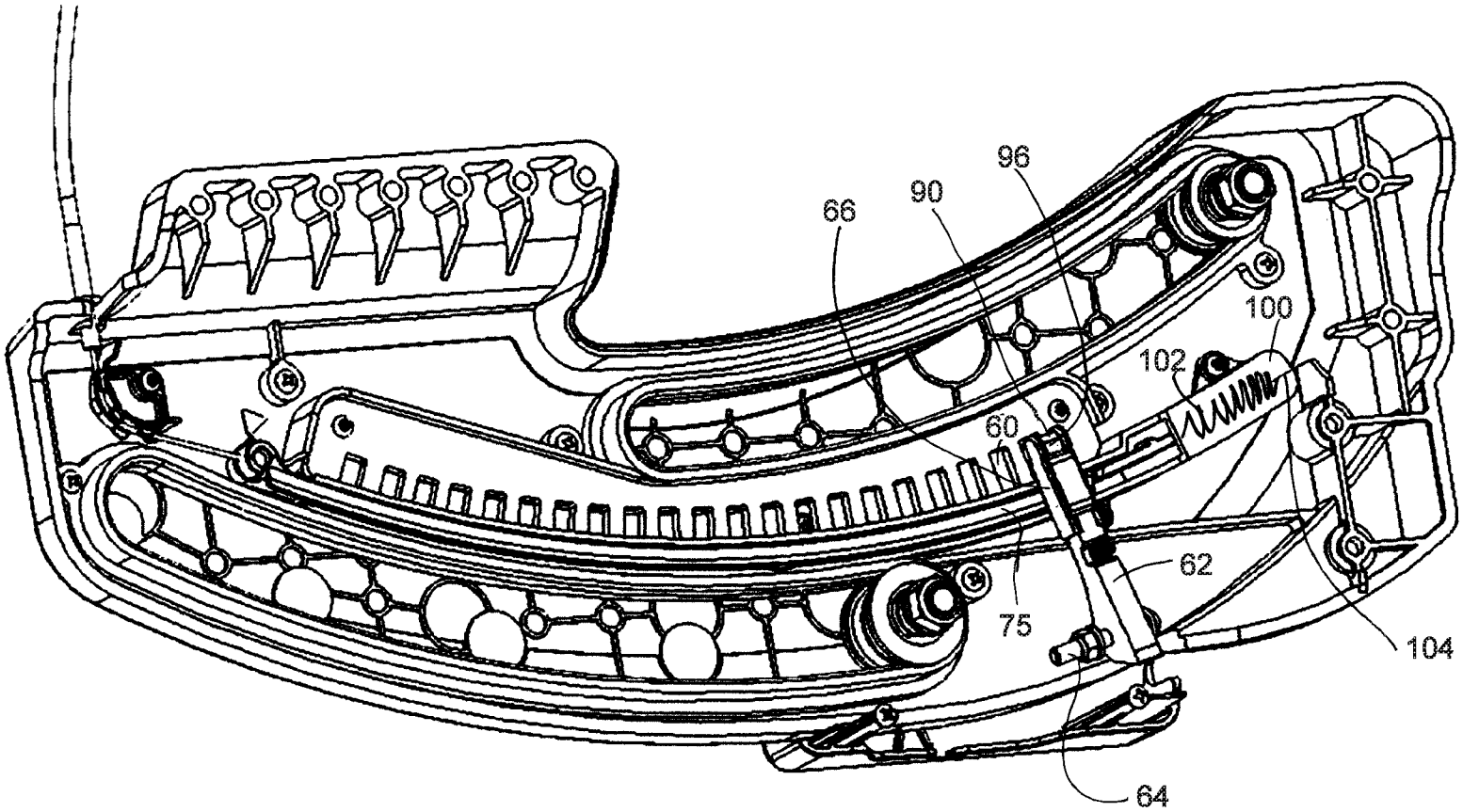
FIG. 5 is a view of the embodiment of FIG. 2 with the locking element disengaged or in an unlocked and tilting position according to a preferred aspect of the present invention.

FIG. 4 shows the angled tab parts in more detail. As can be seen the angled tab slots 58 provide angled surfaces 80 against which the ramps or angled tabs 72 bear. The angled surfaces 80 may be at the same relative angle and the angled tabs 72 may also be at a complementary angle which can now be understood to lift the ejector band 48 away from the bottom of the arcuate groove 56 generally evenly along its length as the angled tabs are drawn up the ramp slots.

Turning now to FIG. 5 the unlocking of the locking tab 62 can be better understood. The locking tab 62 is moveably attached at 64 to an inside face of base frame plate 40 (not shown in this view). In this embodiment the movement is a pivoting movement but the present invention comprehends other types of engaging and disengaging movement as well. As previously described, the base frame plate 40 does not move or change position through the translation of the tilting action seat from one angle to the next. So, by being attached to the frame plate 40, the locking tab 62 also does not change position through translation of the tilting seat from one tilt angle to another. The locking tab 62 may pivot between a locking position, in which it engages one of the locking slots 60, and an unlocked position in which the locking tab is raised clear of all of the locking slots 60 and is resting on the guide surface 75 of the ejector band 48. A lock spring 77 (see FIG. 11) or other biasing element may be used to urge or bias the locking tab into a locked position in any one specific locking slot 60. The spring constant of the locking spring 77 will be weak enough that the spring can be compressed by the force of the ejector band but also strong enough to ensure that the locking tab can be registered with a locking slot when required. In another embodiment, the locking spring can be an extension spring rather than a compression spring, torsion spring or other type of biasing element, such as rubber, located on the opposite side of the pivot point. Such a biasing element will provide adequate results provided the biasing force reliably returns the locking tab to a locked position. Also shown are the pair of tip reinforcing plates 66 which are mounted on either side of the free end 96 or tip of the locking tab 90.

FIG. 5 also shows a return spring system located on the ejector band at an end remote from where the wire 27 is attached at 26. The return spring system elements may consist of a closed end 100, in which return spring 102 is located. There is also a spring post 104 which is part of the side plate 28. The return spring may be attached to the spring post 104 in the closed slot 100 and may bias the ejector band 48 in a direction away from the end 50 where the wire is attached. In other words, the spring biases the ejector band 48 down the angled tabs and back towards the bottom of the arcuate groove 56 and thus returns the ejector band 48 to the lower position within the arcuate groove 56. This in turn lowers the guide surface 75 and permits the locking tab 62 to rotate back into a locking slot 60 at the desired degree of inclination of the wheelchair seat 12. It can now be appreciated that the ramp slots 58 in the arcuate groove 56 guide the ejector band 48 both upwardly during the time it is pulled towards the attachment end 50 by the wire 27, and downwardly when the wire 27 is released (i.e. extended) and the return spring 102 acts on the ejector band 48 to draw it back. Again, although in this case an extension spring is shown, a compression spring is also comprehended.

It can now be understood that FIG. 5 depicts the ejector band 48 in the pulled forward or unlocked position. The wire 27 has pulled the ejector band up the angled tabs, and this has in turn lifted the locking tab 62 out of the locking slot 60. Further, when the ejector band 48 is in the pulled position, it is sized so the guide surface 75 engages the locking tab 90 through the range of tilt for the wheelchair seat. It can now be understood that the guide surface 75 of the ejector band 48 is preferably a smooth and low friction surface that will facilitate the sliding of the locking tab there along. High density nylon, Teflon™, or other low friction plastic materials are preferred although smooth metal is also comprehended for the guide surface. In a preferred embodiment, the bearing portion of the locking tab can be made rounded or smoothed to reduce the risk of the locking tab catching on the ejector band surface, or it can be provided with a plastic liner. The guide surface 75 raises the locking tab 90 above the level of the locking slots 60. As can now be understood the tip reinforcing plates can protect the locking tab 90 from being damaged by ensuring that if it catches on something, such as a top of a locking slot during the tilting of the seat, if the ejector band is not raised far enough, the load will be carried by the tip plates 66 rather than the pivot point of the locking tab. In this way, the tip plates 66 help to protect the locking tab 62 from damage.

Figure 6:
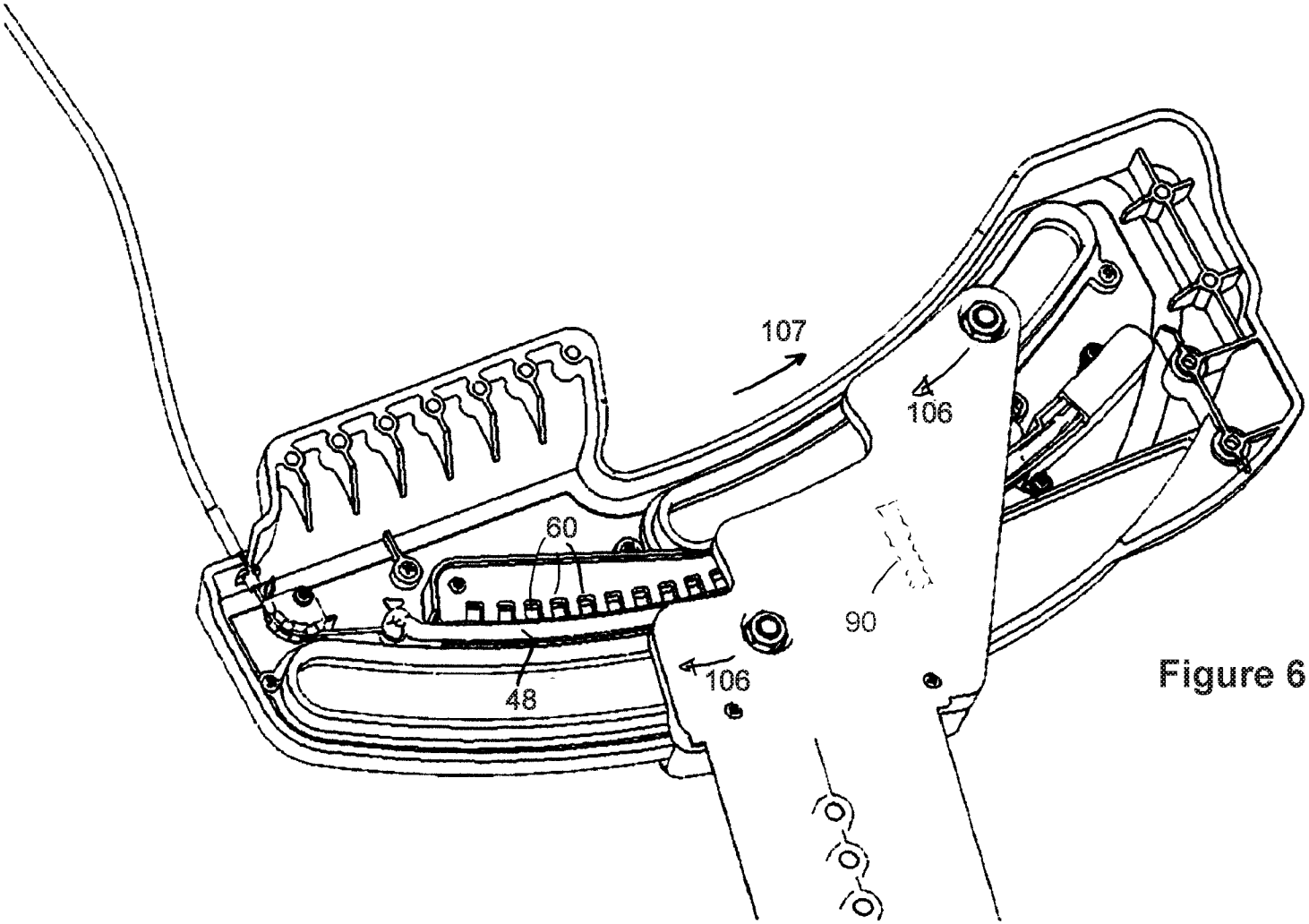
FIG. 6 is the same view as FIG. 4, but with the seat having been tilted and the locking element still disengaged.

Turning now to FIG. 6 the tilting seat frame has been tilted and the rollers are now located further along in the arcuate slots. The rollers have moved in the direction of arrows 106 in their respective slots and the tilting seat has moved in the direction of arrow 107. This has translated the guide surface of the ejector band 48 past the locking tab 90, which as discussed above, is fixed to the frame of the wheelchair and thus does not move relative to the stationary frame (except to pivot in and out of engagement with the locking slots). In the present invention, the locking tab or element is not translated through the range of tilting motion of the wheelchair seat but is in a fixed position relative to the base frame.

Figure 7:
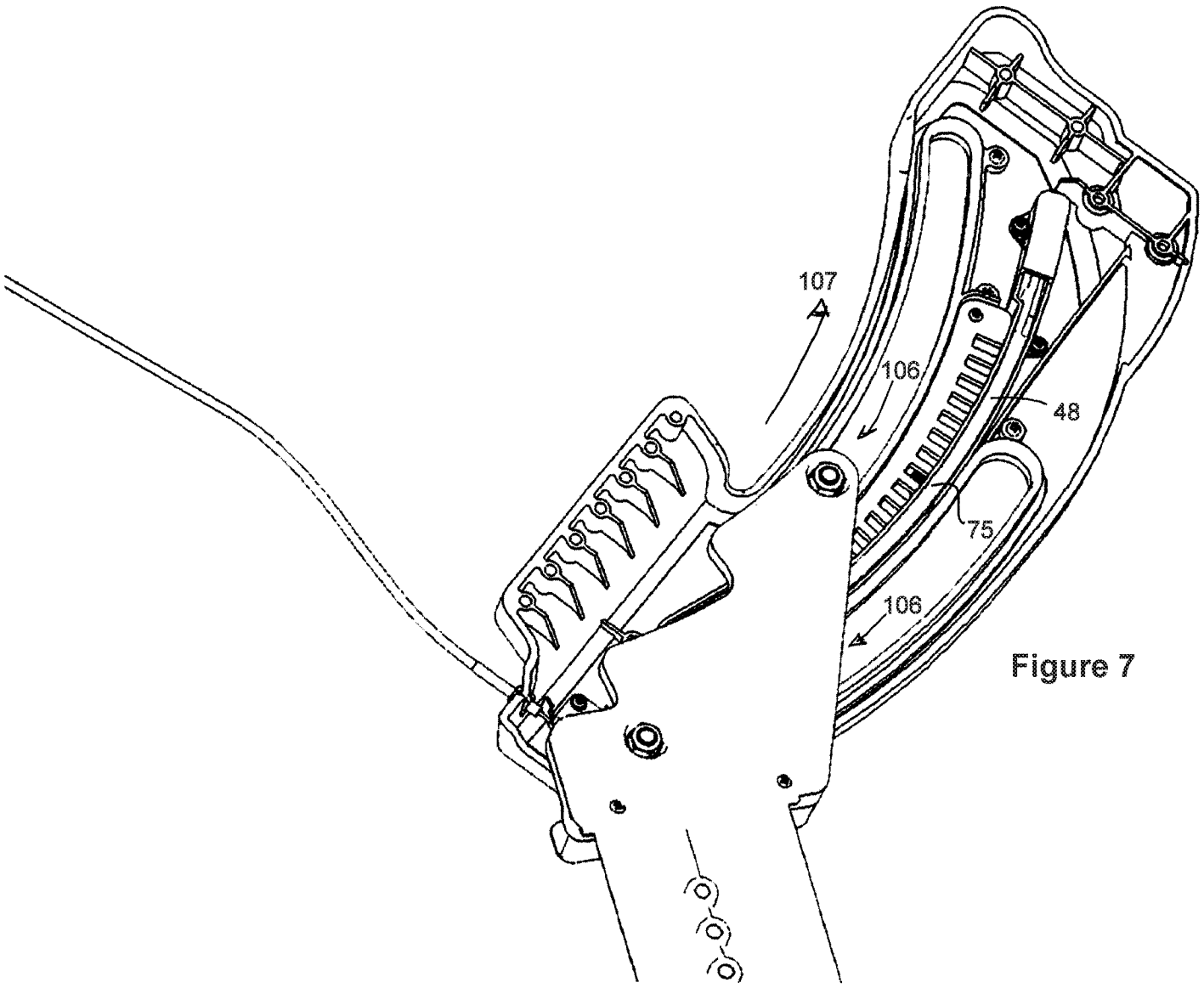
FIG. 7 is the same view as FIG. 6 but the seat has been tilted even more and the locking element has been engaged into a locking indent to secure the seat at that angle of tilt according to a preferred embodiment of the present invention.

Turning now to FIG. 7 the wheelchair seat has been tilted through the full range of motion and the rollers are at the ends of their respective arcuate slots. The manual actuator has been returned to the wire release or tilt locking position, which in turn extends the wire permitting the ejector band 48 to be drawn back down the angled tabs by means of the return spring 102. This has lowered the guide surface 75 and in turn allowed the locking tab 62 to pivot down a furthest locking slot. As previously described the return spring on the locking tab helps bias the locking tab down to re-engage the locking tab or locking element with the appropriate locking slot. In this position, the tilting seat is locked and will not be moveable until the locking tab is once again raised out of the locking slot by the ejector band by shortening the wire by the shifting the manual actuator. As discussed previously, it may be preferred to provide identical tilt lock assemblies on each side of the wheelchair so that the tilting seat is locked on both sides. This potentially requires two manual actuators or levers, one on each handle as shown in FIG. 1. While not essential, the use of two tilt locking assemblies, one on either side of the wheelchair seat, is preferred. Also, the present invention comprehends that if both sides are provided with a tilt lock mechanism, they could both be actuated by a common manual actuator on the handle of the wheelchair.

Figure 8:
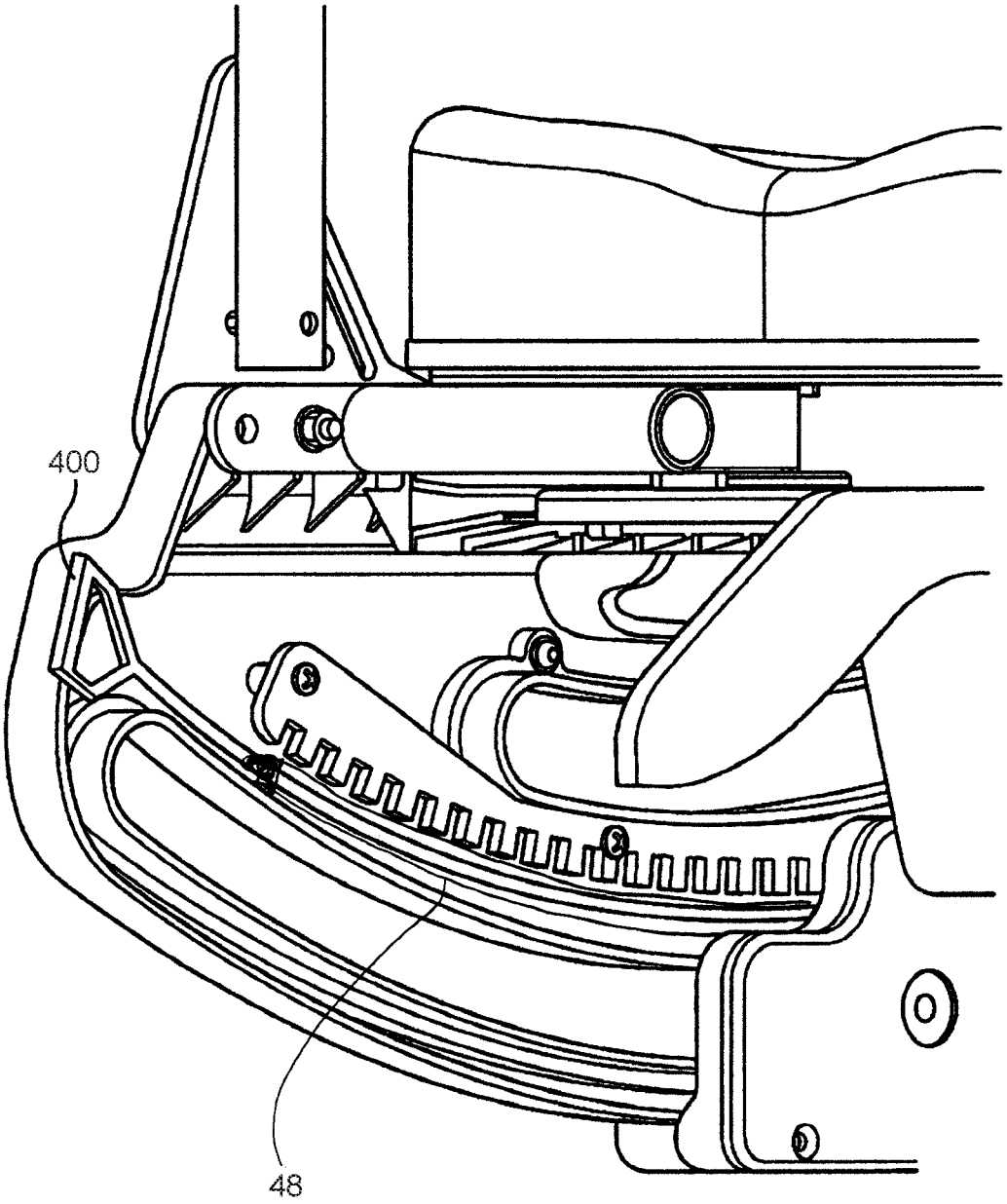
FIG. 8 is an alternate embodiment with a different form of handle to release the tilt lock mechanism.

FIG. 8 shows a further embodiment of the present invention. While generally it is most preferred to locate the actuators on the wheelchair handles, for ease of access for the care givers, in some cases it may be preferred to locate the actuators lower down on the body of the wheelchair for direct access by the occupant. Thus, FIG. 8 shows handle 400 which is directly attached to the ejector band 48 and which can be pulled outwardly to disengage the tilt lock in the same manner as described above. In this example the actuator is directly operatively connected to the ejector band without needing any intervening elements. Essentially in this embodiment the manual actuators and cables have been replaced with the single handle 400. Because the remaining mechanisms of this embodiment are the same as previously describe with respect to the cable actuated tilt lock portion the details are not repeated here. In a further embodiment the movement of the ejector band can be directly controlled by a moveable foot pedal, such as a pivoting foot pedal.

Figure 9:
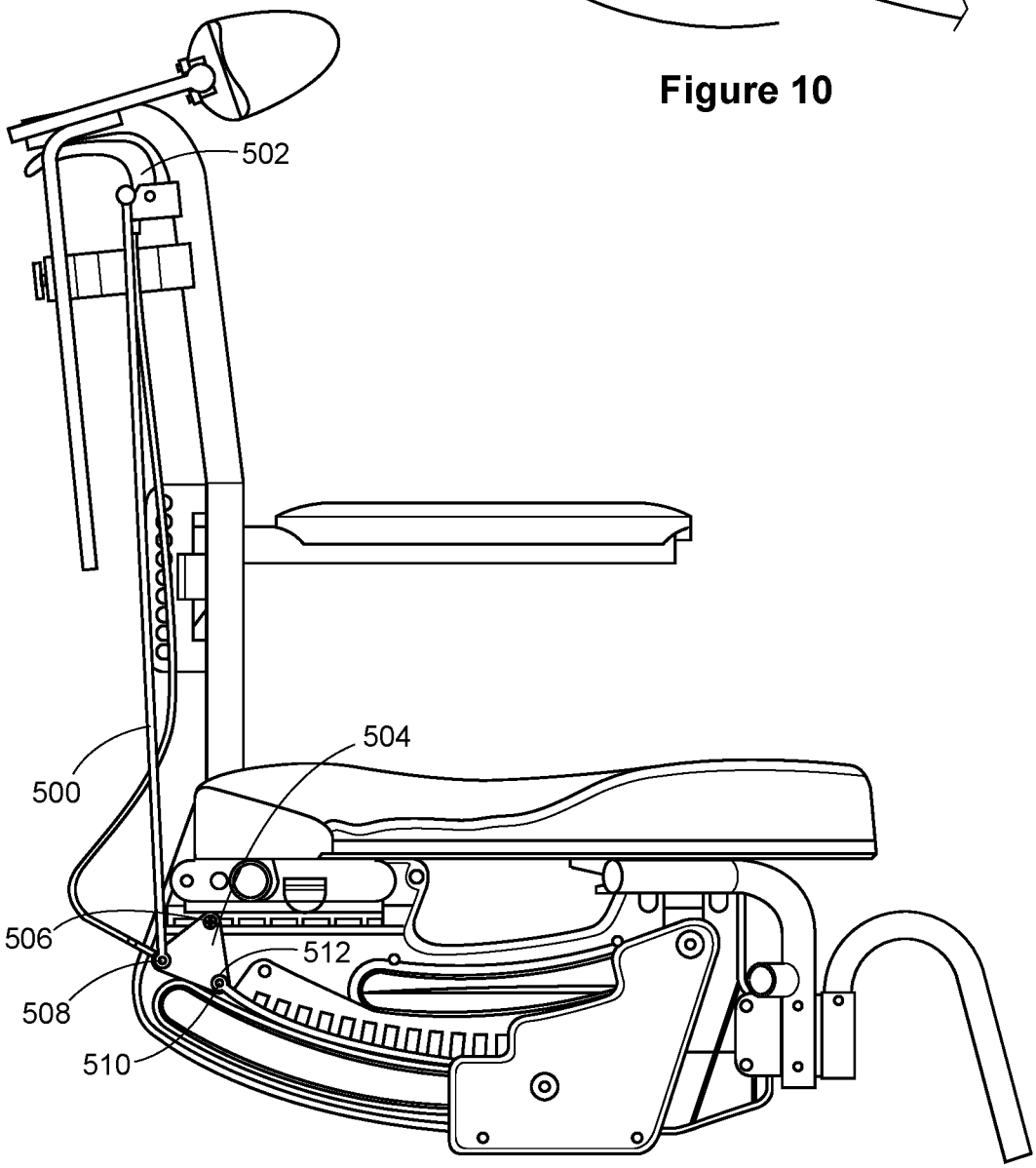
FIG. 9 is an alternate embodiment to the cable actuation system for the invention as shown in FIG. 1.

FIG. 9 shows a further embodiment of the present invention. In this embodiment, rather than a cable, the operative connection between the actuator 22 and the ejector band is a mechanical connection comprising a link rod 500 which is connected at one end to a handle 502 and at the other end to a linkage element 504. The linkage element 504 is pivotally attached to the tilting frame at 506 and the link rod 500 is attached at 508. The end of the ejector band 510 is connected to the linkage element 504 at 512. In this embodiment, the linkage element 504 translates the up/down motion of the link rod 500 caused by the handle 502 into a push/pull movement on the end of the ejector band. The in/out movement of the ejector band in this embodiment has the same effect as previously described in respect of the other embodiments, in terms of locking and unlocking the tilt mechanism. Of course, in this embodiment there is also an additional arc motion described by the end of the ejector band where connected to the link element, due to the configuration of the elements.

Figure 10:
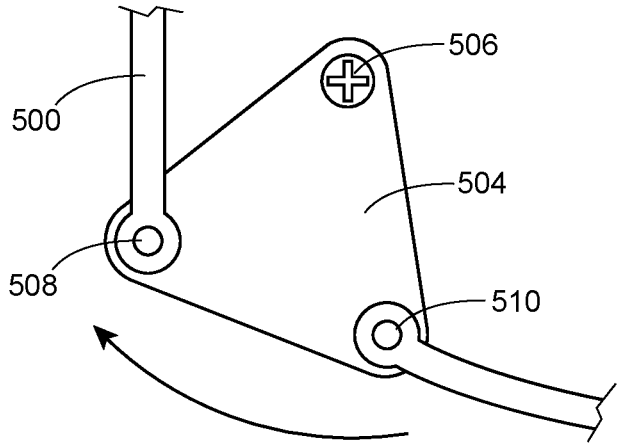
FIG. 10 is a close up view of a linkage element of FIG. 9.

FIG. 10 shows a close up of the linkage element 504 with the pivot point 506 and the two link rod attachments at 508 and 510.

Figure 11A:
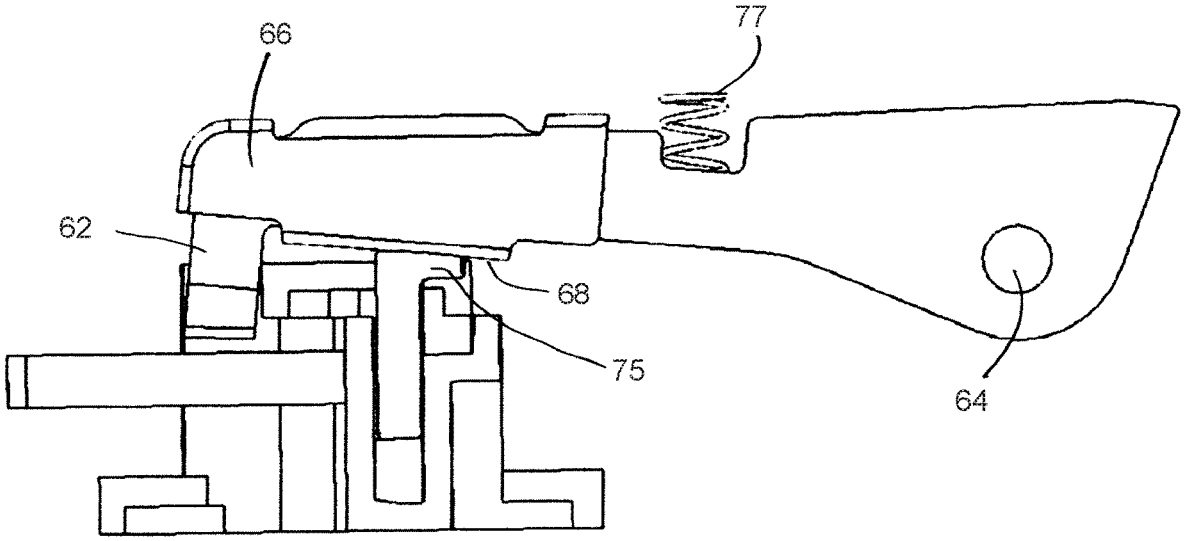
FIG. 11*a* is an enlarged view of the locking element according to a preferred embodiment of the present invention shown in the raised position.
Figure 12:
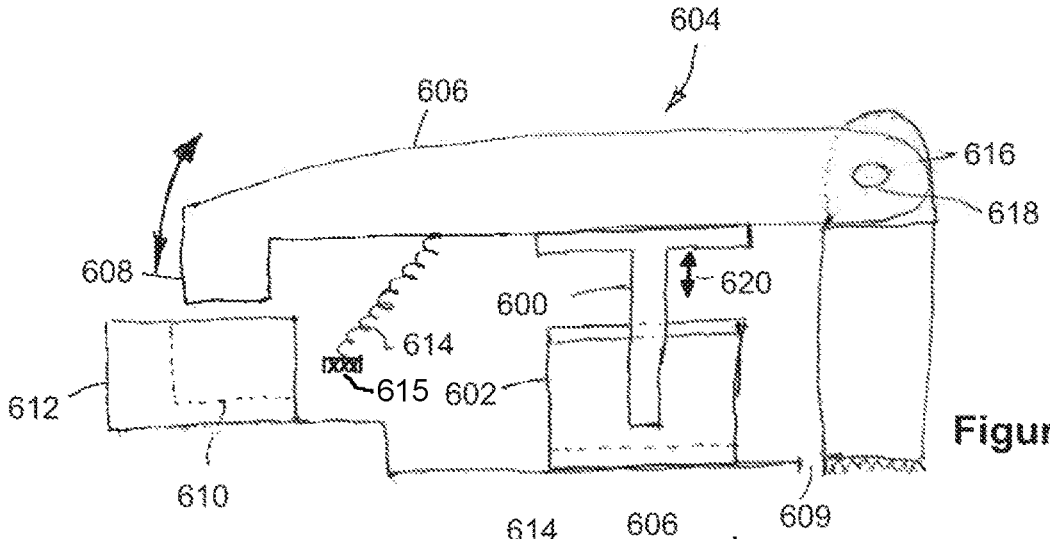
FIG. 12 is a side view of a further embodiment of the present invention.

FIG. 11*a* shows the locking tab 62 raised about the pivot point 64 with the plates 66. The bottom or bearing surface 68 of the locking tab 62 is shown riding on the upper surface 75 of the element 48. The locking spring 77 is in a compressed position and as the element 48 slides back down the ramps, the locking tab 62 will be urged by the compression spring 77 towards the locking slots 60 and eventually into a single locking slot to lock the base frame relative to the seat frame at the desired angle.

Figure 11B:
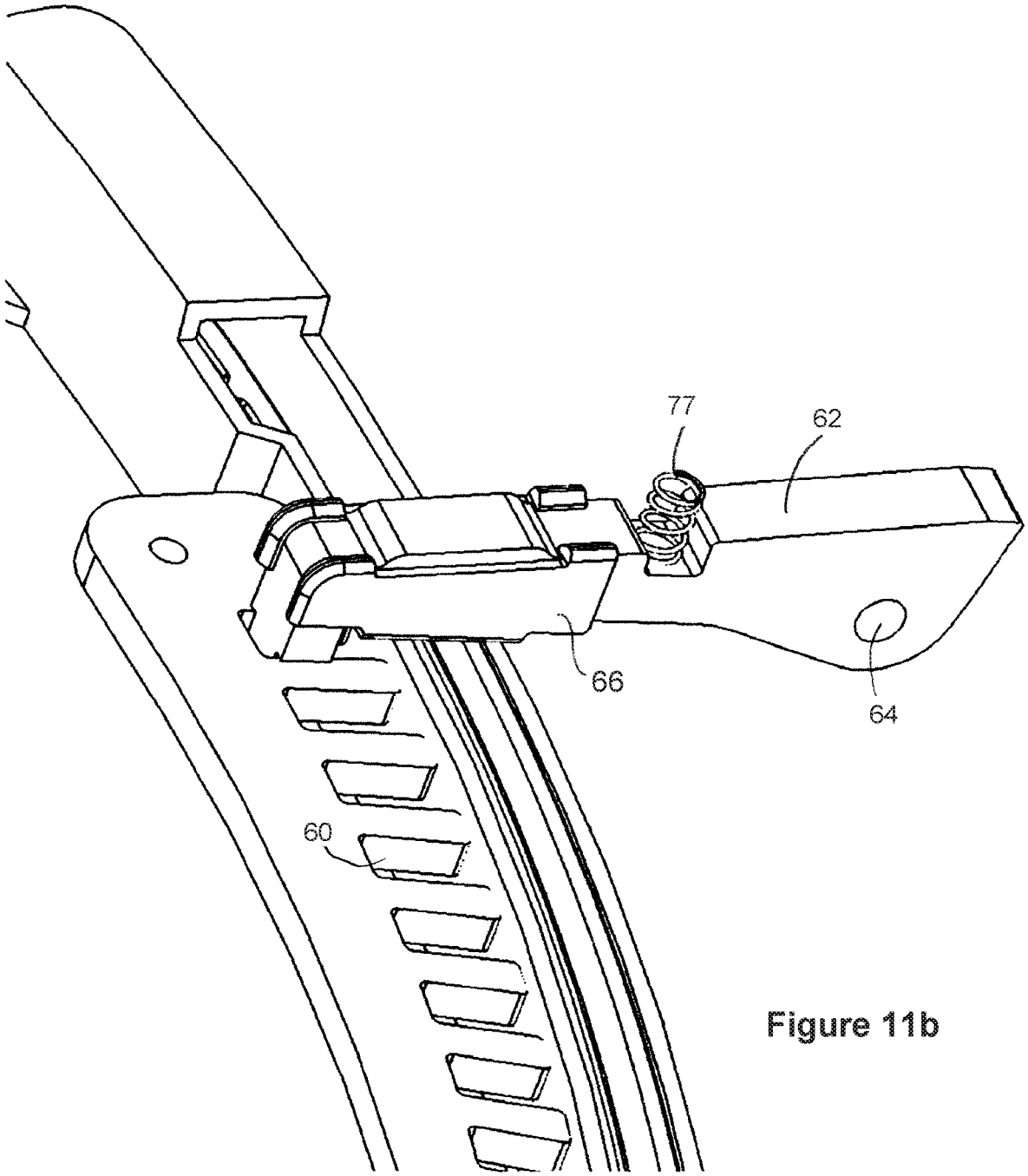
FIG. 11*b* is an enlarged view of the locking element of FIG. 11A shown in the lowered position.

FIG. 11*b* shows the locking tab 62 engaged in a slot 60, locking the tilting part of the seat to the stationary base of the seat.

Figure 13:
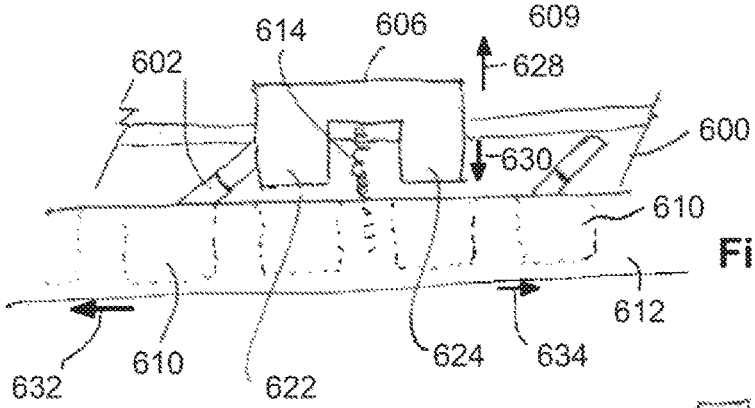
FIG. 13 is an end view of the embodiment of FIG. 12.
Figure 14:
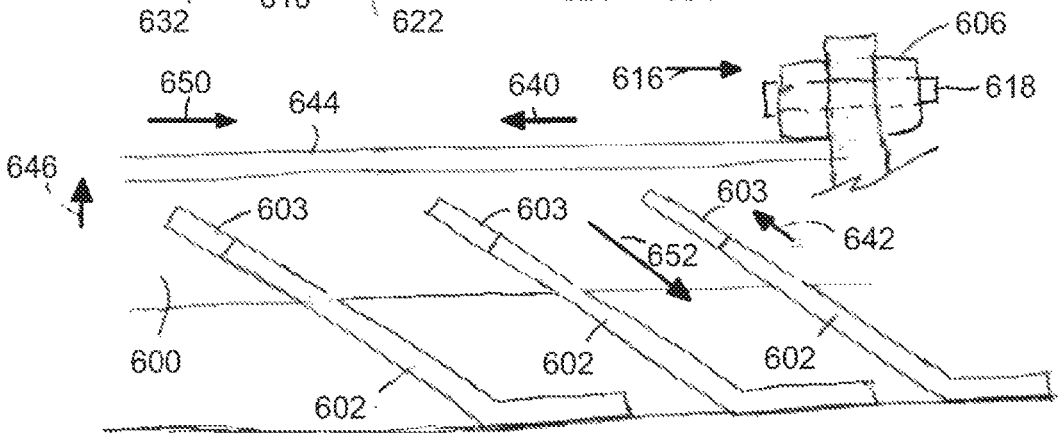
FIG. 14 is a front view of some of the components of the embodiment of FIGS. 12 and 13.

FIGS. 12 to 14 show a further embodiment of the present invention. In FIG. 12 there is a different form of ejector band 600 which rides on inclined flanges 602. The locking tab 604 has pivot arm 606 and one or more locking teeth 608. In a preferred embodiment, two teeth can be used. Locking indents 610 are formed below the locking teeth 608 in a member 612 which is fixed to the tilting portion of the wheelchair seat frame. An extension lock release spring 614 is shown schematically extending between a fixed point 615 and the pivot arm 606. The end of the locking tab 604 remote from the locking teeth is captured in a pivot point 616. A pivot pin 618 is used to secure the locking tab in place. The pivot arm 606 rests on the top of the ejector band 600. As the ejector band 600 is raised and lowered as indicated by double ended arrow 620, the free end of the pivot arm having the locking teeth can be raised or lowered into engagement with the locking indents. The pivot point 616 and the pivot arm 606 are attached to the stationary portion of the wheelchair frame, whereas the locking indents and the ejector band and angled flanges are attached to the tilting or pivoting portion of the wheelchair seat frame. This is shown by means of the gap 609.

FIG. 13 shows the embodiment of FIG. 12 looking at the end of the pivot arm 606 having the locking teeth 608. The fixed member 612 is shown with a plurality of locking indents 610. The pivot arm 606 is shown having two locking teeth 622 and 624. The extensions spring 614 is also shown. The pivot arm 606 can be raised or lowered as shown by arrows 628 and 630, and the element 612 can be moved past the pivot arm as the seat frame is tilted in either direction as shown by arrows 632 and 634.

Turning to FIG. 14, the ejector band 600 is shown riding on a number of angled flanges 602. The angled slots 603 in the ejector band are complementary to the angled flanges 602. As the ejector band 600 is moved in the direction of arrow 640, it will ride up the angled flanges in the direction of arrow 642 which in turn causes the top guide surface 644 of the ejector band 600 to move in direction of arrow 646. In this embodiment the horizontal movement of the ejector band has been translated into vertical movement by means of the complementary flanges and slots 602 and 603. As shown this causes the pivot arm to rotate up and withdraws the locking teeth from the locking indents. Conversely, as the ejector band 600 is moved in the direction of arrow 650 the top surface 644 subsides in the direction of arrow 652 allowing the pivot arm to pivot lower until the locking teeth 622 and 624 engage in the locking indents 610. Although not shown the present invention comprehends that a catch release spring can be used to draw the ejector band or catch release element into the lower of locking position.

Figure 15:
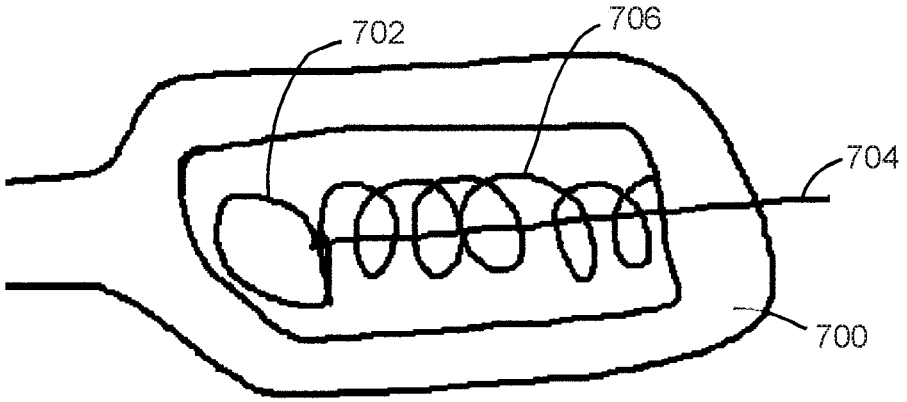
FIG. 15 is a view of another embodiment according to the present invention for attaching the cable to the ejector band.

FIG. 15 shows a further embodiment according to the present invention in which the catch release member or ejector band is depicted as 700, the end of the cable 702, the cable itself is 704 and a safety spring is shown at 706. As shown the spring 706 acts between the cable 702 and the ejector band 700 and is a compression spring. Preferably the safety spring 706 is quite stiff and is only compressed in extreme circumstances. This compression will provide a certain amount of play into the cable/band system which may allow the band to not be damaged if the locking pawl is jammed. In other words, the safety spring 706 may protect the band from being damaged. For example, with the safety spring 706 the band may be considered to be self-protected and attendants may be trained to squeeze the trigger completely and then jiggle the back frame (chair) in order to get the pawl to release. While this is one form of self-protecting the band it will be understood that there are other forms of self-protection comprehended by the present invention, including forming the body of the band itself with zig zags to provide a certain amount of play or placing a tension spring between the band and the end of the cable or the like.

As will be understood by those skilled in the art the present invention comprehends various forms of moving the ejector band other than sliding on ramps as described above. The present invention further comprehends other mechanical equivalents such as having pins in slots, using rollers, linkages, or other mechanical structures in which one element is moved by the attendant or operator, which element interacts with a further element, such as the ejector band, which is constrained to move only in the desired direction to engage or disengage the locking mechanism. The ejector band can move medially laterally as described above, up and down as described above; or it could rotate along it length, without departing from the scope of the present invention. The invention comprehends, for example, pushing a pawl out of vertical teeth in additional to the medial teeth described above, In addition to the foregoing the present invention further comprehends that the ejector band could be an intermediary piece that controls the pawl, rather than being the pawl itself and instead of a pawl into a tooth it could be a multi-toothed pawl into teeth, or a pin into a hole.

Thus, the present invention comprehends, in general, a tilt locking wheelchair that has a locking element mounted to a fixed part or base of the wheelchair and an unlocking mechanism which is mounted to the moving or tilting part of the wheelchair. The unlocking mechanism acts on the locking element to allow the locking element to disengage from a locking position at any degree of tilt of the wheelchair. Among the embodiments comprehended are a rotating locking gear mounted to the base which can be braked to prevent further rotation of the gear and thus further tilt of the wheelchair; a brake applied to the ejector band to prevent the ejector band from moving, which brake can be released and applied as desired to permit or prevent tilting; a friction based type of lock, such as a Mechlok™ which works in a similar manner to a torsion spring barbell clip. In each of these further examples the element that does the locking is on the fixed part of the chair and the unlocking mechanism is on the moving part of the chair.

It will be appreciated by those skilled in the art that the description above relates to preferred embodiments of the invention and that various alterations are possible without departing from the broad scope of the claims which are appended hereto. Some of these variations have been discussed above and others will be apparent to those skilled in the art. For example, the guide surface can be any low friction surface that permits the locking tab to slide thereallong as the angle of the seat relative to the base frame is changed. Further, although the foregoing description provides for translating horizontal movement of the ejector band into vertical movement of the teeth on the pivot arm, the present invention comprehends forms of translation such as using rotational movement of the ejector band to create the required vertical movement of the pivot arm. However, reasonable results have been achieved with the designs as shown in the drawings and as described herein.

The embodiments of the invention in which an exclusive property or privilege is claimed are defined as follows:

1. A tilt lock mechanism for a wheelchair, said wheelchair having a tilting seat portion pivotally mounted to a non-tilting base, said tilt lock mechanism comprising:

an ejector band mounted to said tilting seat portion, said ejector band having a guide surface, wherein, said ejector band being selectively movable between a tilt lock position and a tilt lock release position;

a plurality of locking slots formed in said tilting seat portion;

a locking tab mounted to said non-tilting base, wherein, with said ejector band in said tilt lock position, said locking tab engages at least one of said plurality of locking slots, and, wherein, with said ejector band in said tilt lock release position, said guide surface engages said locking tab with said locking tab out of engagement with said plurality of locking slots; and an actuator operatively connected to said ejector band to move said ejector band between said tilt lock position and said tilt lock release position, wherein said tilting seat portion and said ejector band comprise opposed and complementary angled surfaces to translate at least some longitudinal movement of said ejector band into at least some lateral movement of said guide surface.

2. The tilt lock mechanism of claim 1, further comprising a catch release spring to return said ejector band to said tilt lock position.

3. The tilt lock mechanism of claim 1, further comprising a lock spring to bias said locking tab towards engagement with at least one of said plurality of locking slots.

4. The tilt lock mechanism of claim 1, wherein said tilting seat portion comprises an arcuate groove to house said ejector band.

5. The tilt lock mechanism of claim 4, wherein said arcuate groove further comprises a plurality of angled tabs, defining a first portion of said opposed and complementary angled surfaces, sized and shaped to allow a second portion of the opposed and complementary angled surfaces, defined on said ejector band, to slide up and down said angled tabs in response to said at least some longitudinal movement of said ejector band.

6. The tilt lock mechanism of claim 5, wherein the second portion of the opposed and complementary angled surfaces are distributed along a length of said ejector band to support a length of said ejector band.

7. The tilt lock mechanism of claim 1, wherein said guide surface guides said locking tab past at least a portion of said plurality of locking slots when said ejector band is moved from said tilt lock position to said tilt lock release position.

8. A tilt lock mechanism for a tilting wheelchair, said tilting wheelchair having a tilting seat portion mounted to a non-tilting base, said tilt lock mechanism comprising:

a cable to communicate manual displacement from one end of said cable to the other wherein both ends of said cable are mounted to said tilting seat portion;

a manual actuator operatively connected at one end of said cable and an ejector band operatively connected to the other end of said cable, said ejector band comprising a guide surface to guide a locking tab;

a series of locking indents formed into said tilting seat portion; and a locking tab sized, shaped and positioned to engage one or more of said series of locking indents, said locking tab being mounted to said non-tilting base in a position where said locking tab is engageable with said ejector band and said indents;

wherein movement of said manual actuator moves said cable to cause said ejector band to engage or disengage said locking tab from one or more of said locking indents to allow said tilting seat portion to be tilted to a desired degree of tilt and then locked into said tilted position, and wherein said tilting seat portion and said ejector band comprise opposed and complementary angled surfaces to translate at least some longitudinal movement of said ejector band into at least some lateral movement of said guide surface.

9. The tilt lock mechanism of claim 8, wherein a connection between said cable and said ejector band provides sufficient play to help prevent said ejector band from being damaged by a user pulling or pushing said manual actuator when said locking tab is jammed.

10. The tilt lock mechanism of claim 9, wherein said connection comprises a safety spring.

* * * * *